United States Patent [19]

Wilson

[11] 4,321,603

[45] Mar. 23, 1982

[54] ATTACHMENT FOR ANTENNAS TO IMPROVE RECEPTION AND TRANSMISSION

[76] Inventor: George P. Wilson, 240 Andover St., North Andover, Mass. 01845

[21] Appl. No.: 110,644

[22] Filed: Jan. 9, 1980

[51] Int. Cl.[3] ..... H01Q 1/32

[52] U.S. Cl. ..... 343/750

[58] Field of Search ..... 343/749, 750, 895

[56] References Cited

U.S. PATENT DOCUMENTS

| | | | |
|---|---|---|---|
| 4,038,661 | 7/1977 | Nolte | 343/750 |
| 4,101,898 | 7/1978 | Ingram | 343/895 |
| 4,117,493 | 9/1978 | Altmayer | 343/750 |

*Primary Examiner*—Eli Lieberman

*Attorney, Agent, or Firm*—Edward A. Gordon

[57] ABSTRACT

A device adapted to be attached to an omni-directional antenna having an elongated conductive element adapted to be mounted vertically. The device comprises a non-conductive core member having means for attaching said core member to the elongated conductive element and having an inner open-wound coil having coil turns tightly wound about the non-conductive core member and electrically isolated from the elongated conductive element and an outer open-wound coil attached to the non-conductive core member in spaced relationship from the inner coil and electrically isolated therefrom. The outer coil has its coil turns wound at an angle to the inner coil turns.

10 Claims, 4 Drawing Figures

ATTACHMENT FOR ANTENNAS TO IMPROVE RECEPTION AND TRANSMISSION

BACKGROUND OF THE INVENTION

The present invention relates to antennas and more particularly to a device to be attached to an omni-directional antenna having an elongated conductive element to improve the transmission and reception.

While the discussion of the device of the present invention will be in relation to antennas for citizens band radio antennas for simplicity, it is to be understood that it has application to antennas employed for other frequencies.

Vertical antennas are frequently employed on both land and water mobile vehicles for both transmitting and receiving communications. Most mobile antennas for citizens band radios, for example, are omni-directional and are formed of an elongated conductive element adapted to be mounted vertically. Such antennas are generally constructed of a metallic tube or rod having an electrical length equal to a quarter-wave in length of the desired communication frequency. These range in physical length from about nine feet for 27 MHz to about six inches for 470 MHz. The antenna length may be physically lengthened or shortened to accomodate waves of various frequencies. When this is not practical the antenna is loaded by adding inductance to increase its effective length or by adding capacitance to decrease its effective length. Another type of verticle antenna in use having an elongated conductive element is a helical antenna which consists of an insulating post such as fiberglass and an antenna conductor, such as copper wire, which is wound helically about the post to define the helical antenna.

For motor vehicles, the antennas are generally physically smaller than that required for maximum efficiency and are provided with a loading coil in an effort to compensate for the shortening of the antenna. These antennas have a range less than that desired.

It is therefore the desire of this invention to provide a device which will improve the range of transmission and reception of an omni-directional antenna of the type having an elongated conductive element adapted to be mounted generally vertically.

It is also desirable to provide such a devise for improving the transmission and reception of such types of antennas which can be easily mounted on the existing antenna without modification and is particularly suitable for mobile antennas.

It is also desirable to provide such a device for attachment to such types of antennas which will reduce the static received at the designated frequency.

SUMMARY OF THE INVENTION

The device of the present invention comprises a non-conductive core member having means for attaching the core member about the elongated conductive element of an antenna, an inner open-wound coil having coil turns tightly wound about the non-conductive core member and electrically isolated from said elongated conductive element and an outer open-wound coil attached to said core member in spaced relationship to said inner coil and electrically isolated therefrom, said outer coil having coil turns wound at an angle to said inner coil turns.

In attaching the device of the present invention to an antenna, it is preferable to position it at a point on the antenna where the standing wave ratio (SWR) is less that 1.5 and most approximates a 1.1 to 1 SWR. Where the antenna is provided with a loading coil, the device of the present invention is preferably positioned below it where SWR is achieved as described above.

BRIEF DESCRIPTION OF THE DRAWINGS

For a fuller understanding of the nature and desired objects of the invention, reference should be had to the following detailed description taken in connection with the accompanying drawings, wherein like reference characters refer to corresponding parts through the several views and wherein.

DETAILED DESCRIPTION OF THE INVENTION

Figure 1:
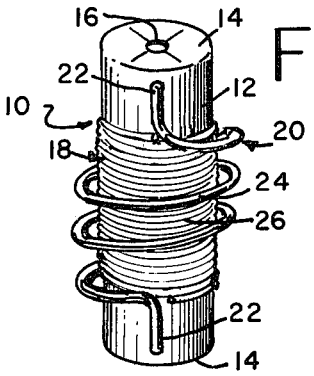
FIG. 1: is a perspective view of the device of the present invention.
Figure 2:
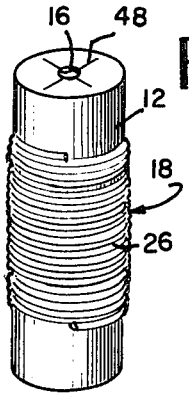
FIG. 2: is a perspective view illustrating the non-conductive core member and the inner open-wound coil thereon of the device of FIG. 1.
Figure 3:
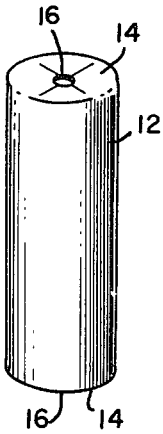
FIG. 3: is a perspective view illustrating the center non-conductive core member of the device of FIG. 1.

Referring now to FIGS. 1,2, and 3 of the drawing, there is illustrated the device of the present invention generally designated with the numeral 10. The device 10 comprises a hollow cylindrical or tubular center core member 12 having the ends 14 covered. The ends 14 of the center core member 12 are provided with openings 16 to receive the elongated conductive element of the antenna upon which it is to be mounted. The openings 16 serve to hold the walls of the cylindrical core member 12 in spaced relationship from the conductive element of the antenna. The ends 14 of the core member are preferably sufficiently flexible to receive various sizes of the elongated conductive element of antennas as will be described hereinafter. The center core member 12 is formed of a non-conductive material such as plastic. While other materials are suitable, the main requirement is that the material be non-conductive and sturdy. Around the mid-portion of the center core member 12 there is tightly wound an inner open-wound coil 18. While copper magnet wire is suitable for forming the coil 18, other magnet wire material formed of metals and alloys can be used. The non-conductive center core 12 electrically isolates the coil 18 from the elongated conductive element of the antenna upon which the device 10 is mounted. By the term electrically isolated as used in the specification and claims it is meant that there is no physical contact.

Disposed upon the center core 12 and in spaced relationship about the inner coil 18 is an outer open-wound coil 20. The ends 22 of the outer coil 20 are attached to the center core 12 at points beyond the inner coil 18 so as to be electrically isolated from the inner coil 18. The outer coil 20 can be formed of any non-ferrous metal or alloy. One suitable metal is aluminum and it's alloys.

The turns 24 of the outer coil 20 are wound at an angle to the turns 26 of the inner coil 18 and is preferably between 40°–50° to maximize operation. The ends 22 of outer coil 20 can be attached to core member 12 by any suitable adhesive (not shown) well known to those skilled in the art.

In a preferred embodiment the coil 18 and center core member 12 and attaching ends of outer coil 20 are coated with a thin heat shrinkable protective plastic coating (not shown). Suitably such protective coating may be of the type described with respect to envelope 44 of FIG. 4.

Figure 4:
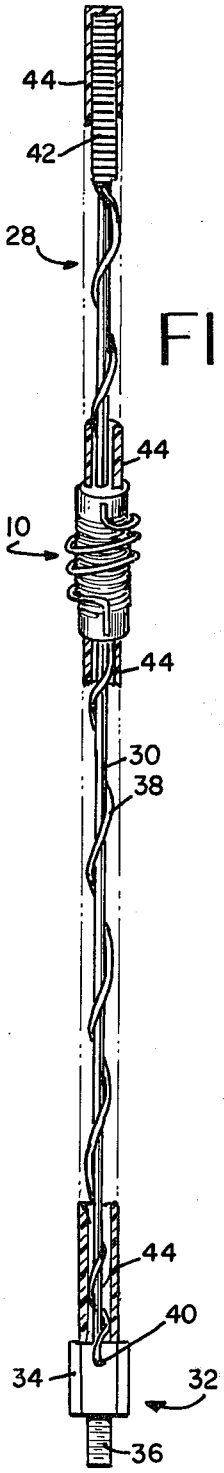
FIG. 4: is an elevational view, partially in section, illustrating the device of FIG. 1 attached to a top-loaded helically-wound vertical antenna for citizen band operation.

Referring now to FIG. 4, there is illustrated the device of the present invention as shown in FIG. 1 attached to a top-loaded helically-wound vertical antenna generally designed with the numeral 28. The antenna is designed for 11 meter citizen band operation within the 25–30 MHz band having a designed midrange resonant frequency of approximately 27 MHz.

The Vertical antenna includes an insulating rod 30 which is attached to a mounting member 32 at its lower end. Mounting number 32 is suitably brass and includes a mounting ferrule 34 to which the rod 30 is epoxied for attachment and having a threaded reduced end 36 for connecting to a matching, female threaded support member mounted on a vehicle or the like. Suitably such a support member would include a spring support (not shown). A coaxial cable, e.g. a standard 52 ohm coaxial cable is connected in the usual manner to the antenna support member and through such support member to the mounting fixture 32. The coaxial cable connects in the usual manner to radio equipment and is utilized alternatively to provide RF energy to the antenna and receive RF energy from the antenna.

The rod 30 is preferably made of a tubular or solid section of fiber glass rod approximately four feet long and supports an electrically conductive element 38 which is preferably 16–20 gauge copper wire having an insulating coating thereon. Suitably the wire 38 is electrically connected to mounting fixture 32 at its lower end 40. At the upper end, of rod 30, the electrically conductive element 38 is tightly wound to provide an upper loading coil 42. The purpose of this loading coil is primarily to reduce the overall height of the antenna. For example, in the 27 Megahertz citizens band, a quarterwave antenna would be approximately 108" long, while the present overall antenna, from tip-to-tip including the mounting fixture 32 is approximately 48" long. The electrically conductive element 38 between the upper loading coil 42 and the mounting fixture 32 is gently wound to provide a larger spaced pitch and an overall helical configuration.

The entire antenna is preferably covered and protected by a weather-tight protective insulating envelope 44. Preferably the envelope 44 is constructed of a tubular plastic material that has been heat shrunk to provide a water-tight insulating envelope over the antenna and the electrical elements.

In attaching the device 10 of the present invention to the antenna it is slipped over the top of antenna 28 by means of end holes 16 and is preferably positioned below the upper loading coil 42. When the holes 16 are not sufficiently wide to clear the upper loading coil 42 for example, the ends 14 are sufficiently slit along the lines 48 from the holes 16 to accomodate passage while, providing a tight fit. The device 10 is then adjusted to "tune" the antenna to obtain the optimum transmission and reception. As is well known, adjustments are made on the basis of a standing wave ratio (SWR) meter measurements. The device 10 is moved upward or downward to a position to obtain optimum transmission and reception. This position is preferably at an SWR reading of 1.5:1 to 1.1:1.

Although not to be taken in a limiting sense an embodiment of the device of the present invention will now be described as employed on the top loaded helically wound vertical antenna of the type described with respect to FIG. 4.

In this embodiment, the center core member 12 is a hollow cylinder formed of a rigid polycarbonate plastic approximately 4 inches long and aproximately 1 inch in diameter. Around the mid-portion of the core member, is wound the inner coil 18, formed of insulated wire, suitably 22 guage enamel covered copper wire. The inner coil is open-wound and is physically attached to the center core but not to the electrically conductive element 38 of the antenna 28. The outer coil 20 is formed of non-ferrous 8 guage wire of approximately 10.5 inches in length and is openwound about the inner coil 18. The ends of coil 20 are physically attached to the center core 12 at points between the ends of the center coil 18 and the ends 14 of the core member 12 but are not physically attached to the center coil or the electrically conductive element of the antenna. The outer coil is preferably wound at an angle of between 40° to 50° to the inner coil turns. With reference to the number of coil turns the inner coil 18 has a majority of turns while the outer coil has a minority of turns. The length of the inner coil is approximately equal to the quarter wave in length for the 27 megahertz band and is approximately 108 inches long. Accordingly, the inner coil has a length of substantially an electrical quarterwave of the antenna's operating frequency. The overall length of the tightly wound inner coil is approximately 1.25 inches on the core member surface. The outer coil turns are wound with spaced turns to form a more gentle overall helical configuration.

It has been found that when the device of the present invention is attached to the elongated conductive element of an omni-directional antenna, it improves voice transmissions and reception, reduces interference and greatly increases the effective range of transmission and reception.

While the invention has been described in connection with certain preferred embodiments, it should be understood that the invention is by no means limited thereto. For example, the center core may be formed of any non-conductive insulating material such as styrofoam, the main requirement being that it hold the inner coil and outer coil in spaced relationship from each other and from the electrically conductive element of the antenna about which it is disposed. Additionally, while the inner coil length has been described as preferably having a length of substantially an electrical quarterwave of the antenna's operating frequency, the length may be varied consistent with the length of the wave of the antenna's operating frequency. For example, where the antenna is a half-wave in length of the operating frequency the inner coil, may be substantially a half-wave in length.

While the theoretical considerations for the operation of the device of the present invention are not completely understood the device appears to strengthen horizontally directed lobes of radiation which extend the operating range of the transmitter or receiver to which the antenna is attached. It is believed that the strengthened field is the result of electrostatic and electromagnetic coupling which cooperate to desirably alter and/or strengthen the radiation pattern.

While the invention has been described with respect to preferred embodiments it will be apparant to those skilled in the art that changes and modifications may be made without departing from the scope of the invention herein involved in its broader aspects. Accordingly, it is intended that all matter contained in the above description, or shown in the accompanying drawing shall be interpreted as illustrated and not in a limiting sense.

What is claimed is:

1. A device adapted to be attached to an omni-directional antenna having an elongated conductive element comprising:

an inner open-wound coil having a majority of coil turns disposed in spaced relationship about said elongated conductive element, and an outer open-wound coil having aminority of coil turns disposed in spaced relationship about, said inner open-wound coil, said inner open-wound coil and said outer open-wound coil being electrically isolated from each other and from said elongated conductive element, said outer open-wound coil turns being wound at an angle to said inner open-wound coil turns.

2. The device of claim 1 wherein:

said outer open wound coil turns are wound at an angle of between 40° to 50° to said inner coil turns.

3. The device of claim 1 wherein:

the length of said outer coil is substantially less than the length of said inner coil.

4. A device adapted to be attached to an omni-directional antenna having an elongated conductive element comprising, a non-conductive core member disposed about said elongated conductive element, an inner open-wound coil having coil turns tightly wound about said non-conductive core member and electrically isolated from said elongated conductive element, and an outer open-wound coil attached to said core member in spaced relationship about said inner open-wound coil and electrically isolated therefrom, said outer coil having coil turns wound at an angle to said inner coil turns.

5. The device of claim 2 wherein:

said outer coil covers a length of said core member greater than the length covered by said inner coil.

6. A device adapted to be attached to an omni-directional antenna having an elongated conductive element comprising, a non-conductive generally cylindrical core member having means for attaching said core member in spaced relationship about said elongated conductive element, an inner open-wound coil having coil turns tightly wound about said non-conductive core member and electrically isolated from said elongated conductive element, and an outer open-wound coil wound about and in spaced relationship to said inner coil and electrically isolated therefrom.

said outer coil having coil ends mounted on the core member portions extending beyond said inner open-wound coil turns, said inner open-wound coil having a majority of turns and said outer open-wound coil having a minority of turns wound at an angle to said inner coil turns.

7. A device adapted to be attached to an omni-directional antenna having a substantially vertical conductive element and having an effective length of substantially an electrical quarter-wave at the antenna's operating frequency comprising:

a non-conductive cylindrical core member having means for attaching said core member in spaced relationship about said vertical conductive element, an inner open-wound coil having coil turns tightly wound about said core member and electrically isolated from said vertical conductive element, and an outer open-wound coil having coil turns wound in spaced relationship to each other and to said inner coil turns and electrically isolated from said inner coil, said inner coil having a length of substantially an electrical quarter-wave of said antenna's operating frequency, said inner coil having a majority of coil turns and said outer coil having a minority of coil turns wound at an angle to said inner coil turns.

8. The device of claim 7 wherein:

said inner coil turns have a diameter substantially less than the diameter of said outer coil turns.

9. The device of claims 7 wherein:

said inner coil turns comprises a metallic wire having a dielectric coating thereon and said outer coil turns comprise a nonferrous metallic wire.

10. The device of claim 7 wherein:

the length of said inner coil is substantially the length of an electrical quarterwave at said antenna's operating frequency.

* * * * *